US008342625B2

(12) United States Patent
Auslander et al.

(10) Patent No.: US 8,342,625 B2
(45) Date of Patent: Jan. 1, 2013

(54) PRINTER INK IDENTIFICATION SYSTEM AND METHOD

(75) Inventors: Judith D. Auslander, Westport, CT (US); Robert A. Cordery, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 1654 days.

(21) Appl. No.: 10/929,824

(22) Filed: Aug. 30, 2004

(65) Prior Publication Data

US 2006/0044332 A1 Mar. 2, 2006

(51) Int. Cl.
*B41J 29/38* (2006.01)
*B41J 2/195* (2006.01)
*B41J 29/393* (2006.01)

(52) U.S. Cl. ..... 347/14; 347/7; 347/19

(58) Field of Classification Search ..... 347/6
See application file for complete search history.

(56) References Cited

U.S. PATENT DOCUMENTS

| | | | | |
|---|---|---|---|---|
| 4,812,994 | A * | 3/1989 | Taylor et al. | 705/410 |
| 4,921,534 | A * | 5/1990 | Jalon | 106/31.15 |
| 5,502,304 | A * | 3/1996 | Berson et al. | 250/271 |
| 6,039,257 | A | 3/2000 | Berson et al. | 235/468 |
| 6,303,929 | B1 * | 10/2001 | Oshima et al. | |
| 6,467,888 | B2 * | 10/2002 | Wheeler et al. | 347/85 |
| 6,502,916 | B1 * | 1/2003 | Naka | 347/14 |
| 6,561,612 | B2 * | 5/2003 | Minckler | 347/19 |
| 6,779,862 | B2 * | 8/2004 | Elgee | 347/14 |
| 2002/0195586 | A1 | 12/2002 | Auslander et al. | |
| 2003/0005303 | A1 | 1/2003 | Auslander et al. | |
| 2003/0041774 | A1 | 3/2003 | Auslander et al. | |
| 2003/0106460 | A1 * | 6/2003 | Imanishi et al. | 106/31.14 |
| 2005/0280686 | A1 * | 12/2005 | Bernhard et al. | 347/105 |

FOREIGN PATENT DOCUMENTS

| | | | |
|---|---|---|---|
| EP | 0219847 | A | 10/1986 |
| EP | 0875384 | A | 4/1998 |
| EP | 1103924 | A2 | 11/2000 |
| WO | 01/17784 | A1 | 3/2001 |
| WO | WO02/092707 | A1 * | 11/2002 |

OTHER PUBLICATIONS

U.S. Appl. No. 10/331,829, filed Dec. 30, 2002.
U.S. Appl. No. 10/692,569, filed Oct. 24, 2003.

* cited by examiner

*Primary Examiner* — Shelby Fidler
(74) *Attorney, Agent, or Firm* — George M. Macdonald; Charles R. Malandra, Jr.; Steven J. Shapiro

(57) ABSTRACT

A printer ink identification system including a detector, an excitation source and a controller. The detector is adapted to detect an excitable feature of an ink forming an indicium on an article. The excitation source is adapted to cause excitation of the excitable feature of the ink. The controller is coupled to the detector. The controller is adapted to initiate a predetermined task based, at least partially, upon input from the detector.

14 Claims, 3 Drawing Sheets

PRINTER INK IDENTIFICATION SYSTEM AND METHOD

BACKGROUND OF THE INVENTION

1. Field of the Invention

The present invention relates to printer ink and, more particularly, to a system for identifying the presence or absence of a particular type of printer ink.

2. Brief Description of Prior Developments

Currently there is no way for a postage meter to determine if a fluorescent ink is being used in a postage meter. Furthermore, there is no way of identifying if either a fluorescent ink is printed or if a fluorescent ink indicium is missing due to a mechanical/electrical problem with the print head. It is important for a postage meter manufacturer to be aware of any of these outcomes to warrant that its meters operate as designed. Any solution to these problems must also be small enough to be implemented in mailing machines. There are sophisticated instruments, unrelated to printers or postage meters, which can give a fluorescent spectral response, but these instruments are very large and expensive.

Currently many printer manufacturers place microchips on their ink cartridges to prevent the printer (or meter) from printing with a counterfeit or wrong ink color cartridge. This protects their supplies revenue and prevents the printer from being damaged by incompatible ink. These chips have to be placed on each of the millions of cartridges produced, and is a significant expense. There is a desire to provide an alternative way of solving this problem. There is a desire to provide a Read After Print (RAP) sensor to protect supplies revenue and prevent damage to postage meters from unauthorized ink usage.

SUMMARY OF THE INVENTION

In accordance with one aspect of the present invention, a printer ink identification system is provided including a detector, an excitation source and a controller. The detector is adapted to detect an excitable feature of an ink. The excitation source is adapted to cause excitation of the excitable feature of the ink. The controller is coupled to the detector. The controller is adapted to initiate a predetermined task based, at least partially, upon input from the detector.

In accordance with another aspect of the present invention, a postage meter is provided comprising a printing section, a detector section and a response section. The printing section is adapted to print a postage indicium on an article with an ink. The ink comprises an identifying feature. The detector section is adapted to detect the identifying feature of the ink. The response system is adapted to perform a predetermined task based, at least partially, upon the detector detecting a threshold value of the identifying feature of the ink.

In accordance with one method of the present invention, a method of printing is provided comprising steps of inserting an ink in a printer; sensing, by a sensor of the printer, an identification characteristic of the ink; and initiating a predetermined task by the printer when the sensor sends a predetermined signal to a controller of the printer.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
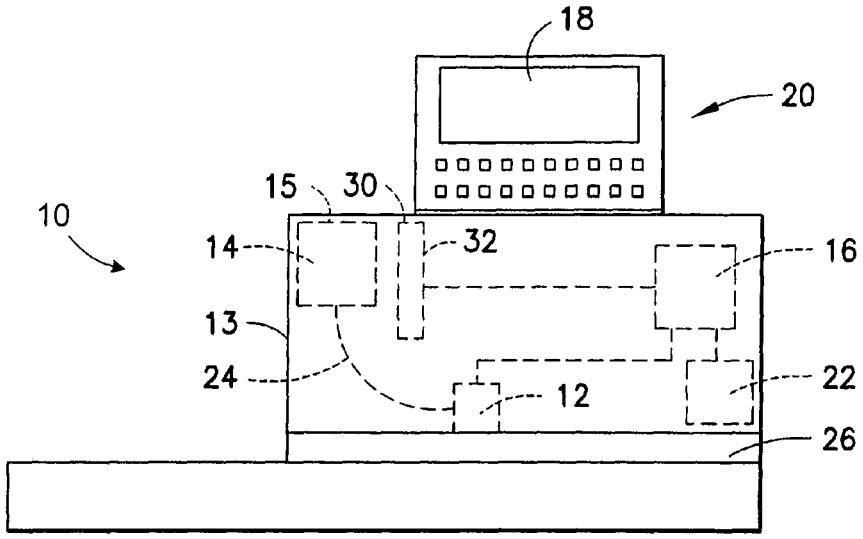
FIG. 1 is a front elevational view of a postage meter incorporating features of the present invention.

Referring to FIG. 1, there is shown a front view of a postage meter 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

The postage meter 10 generally comprises a print head 12, a housing 13 having an area 15 for receiving a removable ink cartridge 14, a controller 16, a display 18, an input section 20 and a communications section 22. The print head 12 is preferably an inkjet print head. A supply line 24 is adapted to supply ink from the ink cartridge 14 to the print head. In an alternate embodiment, the print head could be integrally formed with the ink cartridge. The controller 16 can comprise any suitable type of controller, such as a microprocessor. The controller 16 is operably coupled to the print head 12 to control the print head. The print head can print postage indicium on an article, such as an envelope or tape strip, traveling along the article slot 26. The controller 16 is also coupled to the communications section 22, the display 18 and the input section 20 as is generally known in the art. The communications section 22 can comprise a telephone modem. In an alternate embodiment, the communications section 22 need not be provided.

The ink cartridge 14 preferably contains a luminescent ink, such as a fluorescent ink or a phosphorescent ink. Color fluorescent inks, including black fluorescent ink, are known such as described in U.S. patent application publication Nos. US 2002/0195586 A1, US 2003/0005303 A1, and US 2003/0041774 A1, which are hereby incorporated by reference in their entireties. The color fluorescent ink could be any suitable color including, for example, red or blue. Invisible fluorescent inks are also described in U.S. patent application Ser. No. 10/331,829 filed Dec. 30, 2002, which is also hereby incorporated by reference in its entirety. Use of fluorescent inks for hidden indicia is described in U.S. patent application Ser. No. 10/692,569, filed Oct. 24, 2003 which is also hereby incorporated by reference in its entirety.

In a preferred embodiment, a color fluorescent ink is used which comprises an identification taggant, such as a rare earth complex for example. The taggant forms an excitable feature of the ink, such as fluorescence or phosphorescence. One example of a rare earth taggant is LUMILUX® CD 380, which is a rare earth complex sold by Rieldel-de Haen, which is a part of Honeywell Specialty Materials. However, in alternate embodiments, any suitable taggant or rare earth complex taggant could be used. Other types of a multi-signal transmission inks could comprise inks that have a magnetic or electrical component to enable detection of a magnetic signal or an electrical signal in addition to an optical signal.

Luminescent ink, such as fluorescent ink, can be used by a government postal service, such as the U.S. Postal Service (USPS), to validate or confirm that a postage indicium is authentic. The luminescent ink can also be used to place a marking on a postage indicium by the postal service to indicate that the postage value has been used or consumed. In the past there was no way for a postage meter to determine if a fluorescent ink was being used in the postage meter. Furthermore, there was no way of identifying in the postage meter itself if either a fluorescent ink was printed, or if a fluorescent ink indicium was missing or incomplete due to a mechanical/electrical problem with the print head.

The present invention can use a special taggant in the ink, such as a rare earth complex, that emits in a very narrow wavelength range that can be detected with a photoelectric cell installed in the meter. If it is determined that the ink installed in the postage meter is not an approved type of ink, a signal can trigger a security lock in the postage meter that prevents use of the meter.

Figure 2:
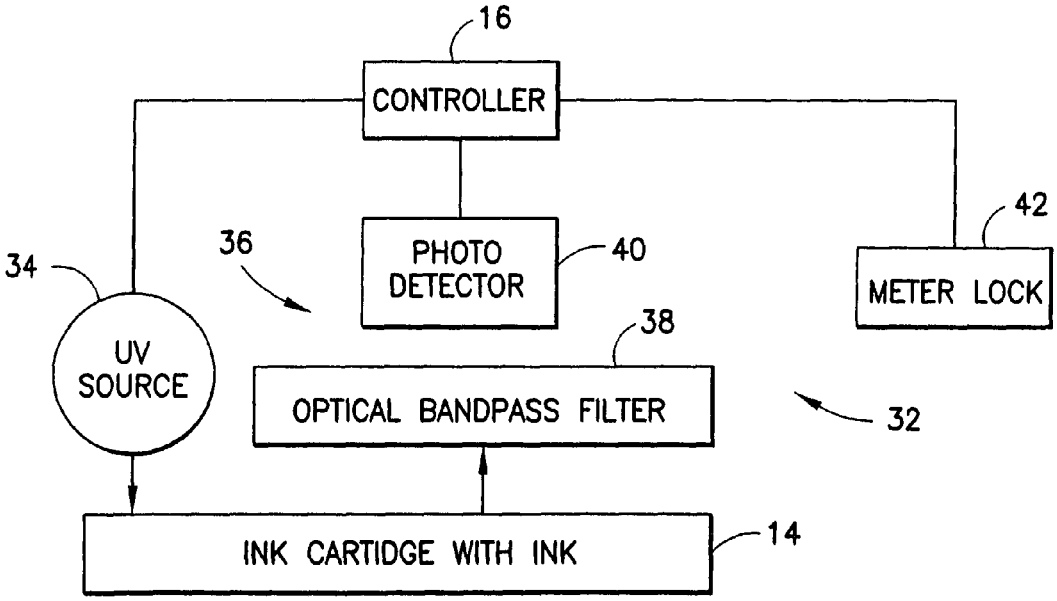
FIG. 2 is a diagram showing components of the postage meter shown in FIG. 1.

In the embodiment shown in FIG. 1, the postage meter 10 comprises a printer ink identification system 30 which comprises the controller 16 and a detection system 32. Referring also to FIG. 2, the detection system 32 has an ultraviolet (UV) source 34 and a detector 36 that is sensitive mainly in the region around an emission line of the taggant. The detector 36 preferably comprises a photoelectric cell 40 and an optical filter 38. The narrow range of sensitivity can be achieved with the optical filter 38. The controller 16 can control the UV source 34.

When the UV source 34 is ON, it can excite the luminescent material in the ink in the ink cartridge 14. The optical bandpass filter 38 can block luminescent emissions other than those in the band close to the emission line of the taggant. The detector 36 can detect a strong signal from the ink and send a message indicating a strong signal to the controller 16 if the taggant is present in the ink, and otherwise detects a weak signal from the ink and does not send a signal to the controller (or sends a message indicating a weak signal to the controller). The meter can also determine whether the optical signal from the ink is above or below a predetermined threshold, or if the signal from the detector to the controller is above or below a predetermined threshold. There can be several options for the meter if the signal is too low. One embodiment could comprise the meter 10 comprising a meter lock 42. The lock 42 could be actuated by the controller 16 when the taggant is not identified as being present in the ink cartridge 14. In one type of embodiment, the lock 42 could comprise a software program to prevent the meter from printing indicium.

Figure 3:
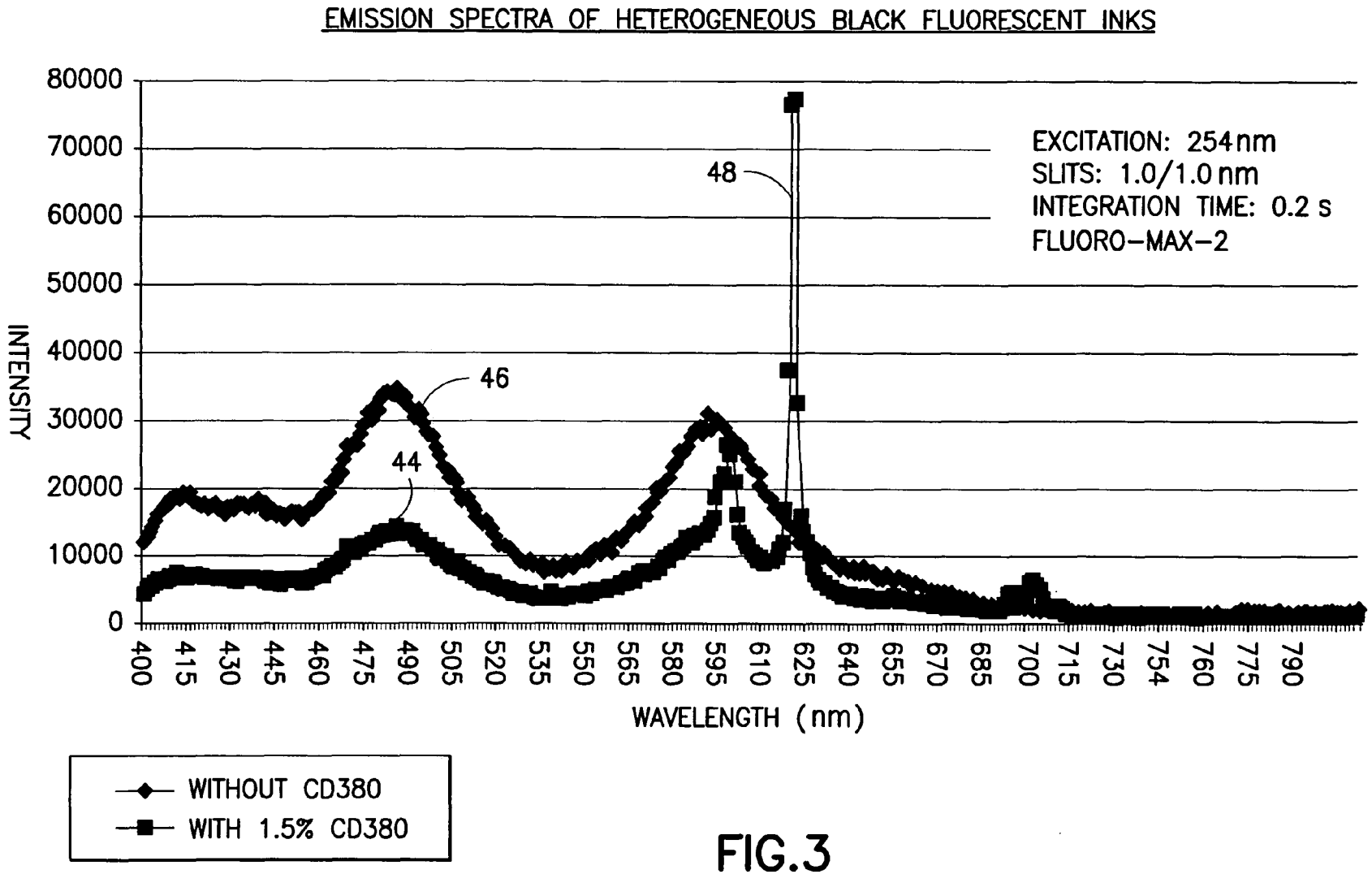
FIG. 3 is a chart of emission spectra of two inks.

FIG. 3 shows a chart of an example of an emission spectra of heterogeneous black fluorescent inks with a 1.5% rare earth complex LUMILUX® CD 380 as an identification taggant (ink 44), and without the taggant (ink 46). The excitation was 254 nm. As can be seen, with the taggant, the ink 44 had a spike 48 in intensity at about 615 nm. Thus, the optical bandpass filter 38 could be a 615 nm filter for this type of ink. In alternate embodiments, the bandpass filter would be selected based upon the predetermined intensity spike for the selected taggant. The bandwidth of the intensity spike is not more than 25 nm.

The present invention can be used to prevent unidentified inks from being used in the printer that may not meet product and/or postal requirements. Unidentified inks can cause problems with functioning of the printer or problems with detection in postal scanning and facing equipment. The present invention can use an ink, such as a black fluorescent ink, or other postage meter ink. A taggant can be added to the ink that can be specifically detected with a matching detector. The taggant can have a unique emission spectrum. The sensitivity region of the detector can overlap the sharp emission line of the taggant. The ink with the taggant can have a sharp emission spectrum, such as around 615 nm. This ink (such as ink 44) can be easily distinguished from an ink without the taggant (such as ink 46). Based upon a signal sent by the detector to the controller, the meter 10 can perform one or more of the following exemplary predetermined tasks:

- block operation of the meter; and/or
- record the fact that a substitute ink is being used (such as in a memory of the postage meter 10); and/or
- inform the user (such as at the display 18) that a substitute ink can damage the printer or may not meet postal requirements; and/or
- send information to a data center (such as with communications section 22) about which kind of ink is in use.

In one type of embodiment, the ink taggant could be detected through phosphoresce. In the case of a phosphorescence ink, the controller 16 could turn the UV source 34 ON and OFF. While the UV source 34 is in the OFF state, the phosphorescence will continue for a while. The detector 36 can look while the UV source 34 is OFF for the emission from a phosphorescent taggant. This reduces the need for an optical filter, although it can still be used to increase the selectivity. In an alternate embodiment, the source 34 could comprise any suitable type of radiant excitation source. The system could also comprise more than one detector, such as detectors sensing different wavelengths or different characteristic features of the ink.

Figure 4:
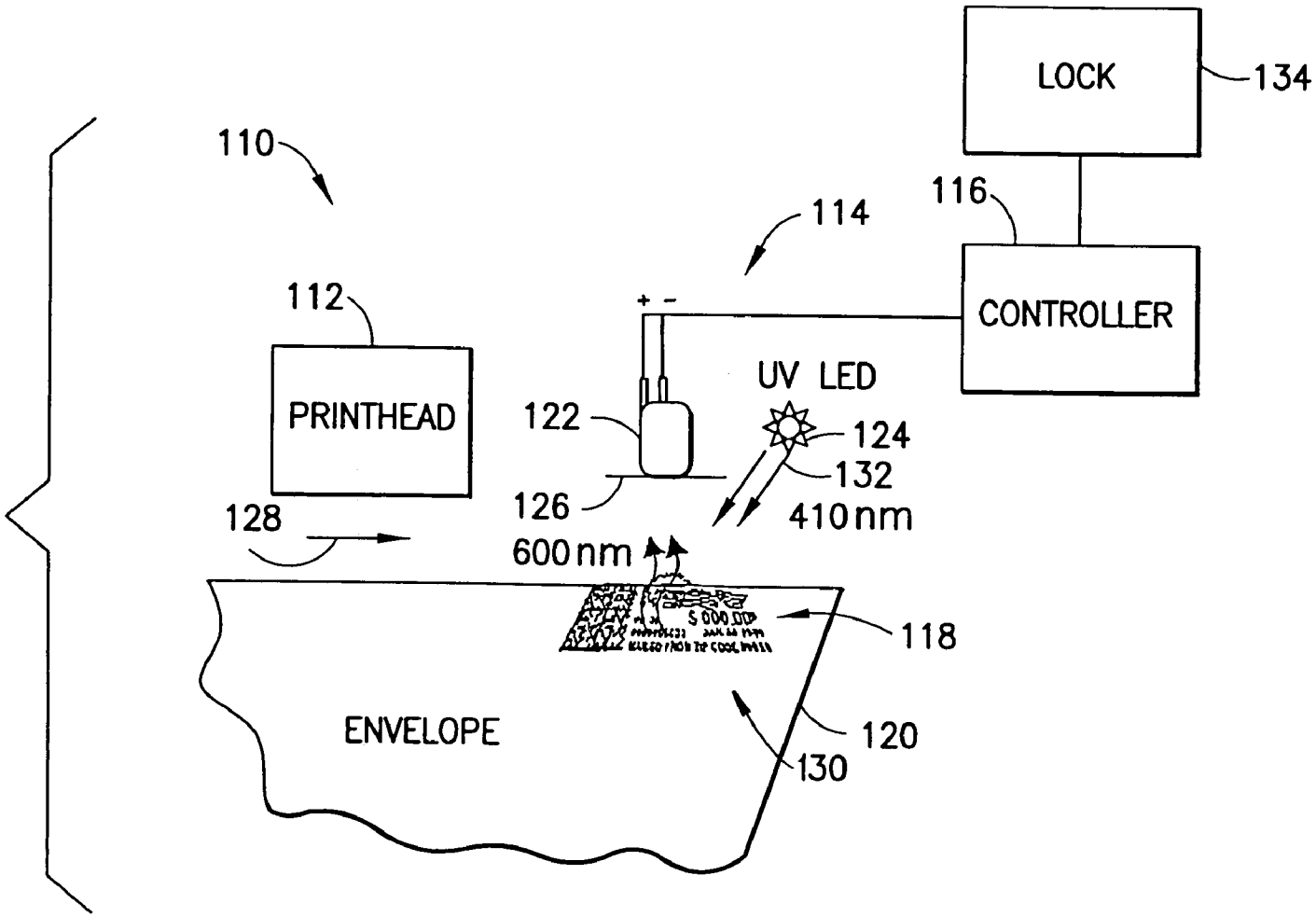
FIG. 4 is a diagram of components of an alternate embodiment of the present invention.

FIG. 4 shows an alternate embodiment of the postage meter. The postage meter 110 generally comprises a print head 112, a printer luminescent ink sensor 114, and a controller 116. The postage meter 110 preferably comprises other features such as a display, an input device, and a data communications device (such as a modem), not shown.

The print head 112 is adapted to print a postage indicium 118 on an article 120, such as an envelope or an adhesive paper strip. The print head 112 uses an ink jet printing method. The ink used to print the indicium 118 preferably comprises fluorescent ink. The sensor 114 is located downstream from the print head 112. In other words, as the article 120 moves is direction 128, the indicium 118 is printed by the print head and then moves along a sensing location 130 at the sensor 114. The sensor 114 generally comprises a photodetector 122 and a radiant energy source or excitation source 124. The photodetector 122 generally comprises a phototransistor. However, any suitable type of photodetector could be used. The radiant energy source 124 generally comprises an ultraviolet (UV) light emitting diode (LED). The LED comprises a 410 nm LED. However, any suitable type of radiant energy source could be used. The sensor 114 also comprises a filter 126. The filter 126 is a wavelength filter, such as a 550 nm high pass filter. However, any suitable filter could be provided. The filter is located in front of the phototransistor, between the phototransistor and the indicium 118.

Similar to the system described with reference to FIG. 2, the controller 116 can control the UV source 124. When the UV source 124 is ON, it can excite the luminescent material in the ink in the indicium 118. The optical bandpass filter 126 can block luminescent emissions other than those in the band close to the emission line of the taggant. The detector 122 can detect a strong signal and send it to the controller 116 if the taggant is present in the ink, and otherwise detects and sends a weak signal. The meter can determine whether the signal is above or below a predetermined threshold. There can be several options for the meter if the signal is too low, such as those noted above. The lock 134 could be actuated by the controller 116 when the taggant is not identified as being present in the ink of the indicium 118. In one type of embodiment, the lock 134 could comprise a software program to prevent the meter from printing additional indicium. The controller could be adapted to send a signal, as the predetermined task, to prevent printing of indicium with the ink. The controller could be adapted to send a signal, as the predetermined task, to record an event in a memory. The controller could be adapted to send a signal, as the predetermined task, to display a message to a user on a display. The controller could be adapted to activate a communications section, as the predetermined task, to send information to a remote location.

By using an ultraviolet (UV) light emitting diode (LED) and a detection system located downstream from the print head, the postage meter can determine the type of ink (fluorescent or non-fluorescent) that was printed on the envelope. The postage meter can use this information to warn the user of problems with the ink supply or if the wrong ink has been used. These are problems that can now be addressed by the drop in cost of detector components (UV LED, phototransistors). The system of FIG. 4 could be used in addition to the system of FIG. 2 or in addition to the system of FIG. 2. In addition, the ink does not need to have an additional "taggant". The detector could merely be selected to detect a predetermined intensity of a narrow bandwidth feature or predetermined spectra pattern of the ink.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A printer ink identification system comprising:

a detector adapted to detect an excitable very narrow band luminescent taggant signal feature of an ink consisting of a less than 25 nm bandwidth signal, wherein the ink exhibits a background luminescent spectral output at a first maximum intensity level that is relatively wideband compared to the narrow band taggant signal, that overlaps the narrow band taggant wavelength when excited and wherein the ink also exhibits the relatively narrow band luminescent taggant signal feature spectral output at a higher second intensity level when excited, wherein the second intensity level is at least three times higher than an intensity level adjacent to the very narrow band luminescent taggant signal;

an excitation source adapted to cause excitation of the excitable taggant signal feature of the ink; and a controller coupled to the detector, wherein the controller is adapted to initiate a predetermined task based, at least partially, upon input from the detector, wherein the detector is adapted to provide said input to the controller only if the second intensity is detected even when the first intensity is detected.

2. A printer ink identification system as in claim 1 wherein the detector comprises a photoelectric cell.

3. A printer ink identification system as in claim 2 wherein the detector comprises an optical bandpass filter.

4. A printer ink identification system as in claim 3 wherein the excitation source comprises an ultraviolet light source and the bandpass filter is approximately 25 nm wide.

5. A printer ink identification system as in claim 1 wherein the detector comprises a photodetector that is adapted to detect luminescence of a taggant at a level above a background luminescence threshold to the ink as the excitable feature.

6. A printer ink identification system as in claim 5 wherein the relatively wideband background luminescent spectral output luminescence is concentrated in the red region of the visible electromagnetic spectrum from 580 nm to 625 nm.

7. A printer ink identification system as in claim 5 wherein the photodetector is adapted to detect phosphorescence of the taggant.

8. A printer ink identification system as in claim 5 wherein the photodetector is adapted to detect the relatively narrow band fluorescence of the taggant above a background threshold.

9. A printer ink identification system as in claim 8 wherein the photodetector is adapted to detect fluorescence of an additive in a narrow wavelength range of approximately 25 nm wide.

10. A printer ink identification system as in claim 9 wherein the additive is a rare earth complex.

11. A printer ink identification system as in claim 1 wherein the controller is adapted to send a signal, as the predetermined task, to prevent printing of indicium with the ink.

12. A printer ink identification system as in claim 1 wherein the controller is adapted to send a signal, as the predetermined task, to record an event in a memory.

13. A printer ink identification system as in claim 1 wherein the controller is adapted to send a signal, as the predetermined task, to display a message to a user on a display.

14. A postage meter comprising:

a printing section adapted to print a postage indicium on an article with an ink; and a printer ink identification system as in claim 1, wherein the detector for relatively narrow band luminescent taggant signal feature and the excitation source are located proximate an ink cartridge receiving area of the postage meter to sense the ink while the ink is in the cartridge, and wherein the controller coupled to the detector is adapted to activate a security lock on the postage meter to prevent further printing by the postage meter upon input from the detector.

* * * * *